US009346590B2

(12) United States Patent
Ramsey

(10) Patent No.: US 9,346,590 B2
(45) Date of Patent: May 24, 2016

(54) SCREW LID FOR A FOOD CONTAINER

(71) Applicant: Crown Packaging Technology, Alsip, IL (US)

(72) Inventor: Christopher Paul Ramsey, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/372,889

(22) PCT Filed: Jan. 15, 2013

(86) PCT No.: PCT/EP2013/050662

§ 371 (c)(1),
(2) Date: Jul. 17, 2014

(87) PCT Pub. No.: WO2013/107736

PCT Pub. Date: Jul. 25, 2013

(65) Prior Publication Data

US 2014/0332493 A1 Nov. 13, 2014

(30) Foreign Application Priority Data

Jan. 17, 2012 (GB) ..... 1200726.6

(51) Int. Cl.
*B65D 41/04* (2006.01)

(52) U.S. Cl.
CPC ..... *B65D 41/0485* (2013.01)

(58) Field of Classification Search
CPC .... B65D 41/0485; B65D 41/04; B65D 41/34; B65D 39/0023; B65D 39/0005; B65D 39/10; B65D 39/08; B65D 39/00
USPC ..... 215/305, 295, 330, 329, 316, 356, 355, 215/360, 358; 220/293, 288, 790, 789, 787, 220/780, 802, 801, 800, 796; D9/435, 443
See application file for complete search history.

(56) References Cited

U.S. PATENT DOCUMENTS

| | | | | |
|---|---|---|---|---|
| D248,217 | S * | 6/1978 | Allen et al. | D9/443 |
| 5,672,321 | A * | 9/1997 | Daykin | 422/557 |
| 5,803,287 | A | 9/1998 | Kusz | |
| 5,941,404 | A | 8/1999 | Charrette | |
| 6,253,942 | B1 * | 7/2001 | Elias | 215/305 |

(Continued)

FOREIGN PATENT DOCUMENTS

| | | | |
|---|---|---|---|
| BE | 384256 | A | 11/1931 |
| DE | 732930 | C | 3/1943 |
| DE | 2609676 | A1 | 9/1977 |

(Continued)

OTHER PUBLICATIONS

Translation of DE 202006010719 (Thielen Feinmechanik), Oct. 12, 2006, p. 2.*

(Continued)

*Primary Examiner* — Robert J Hicks

(74) *Attorney, Agent, or Firm* — Baker & Hostetler LLP

(57) ABSTRACT

A screw lid for a food container comprises a series of radially extending asymmetric protrusions arranged around a peripheral edge region, wherein the asymmetric protrusions facilitate enhanced gripping when the lid is turned in an opening direction as compared to the gripping facilitated when the lid is turned in a closing direction.

18 Claims, 4 Drawing Sheets

(56) References Cited

U.S. PATENT DOCUMENTS

| | | | | | |
|---|---|---|---|---|---|
| D613,161 | S * | 4/2010 | Greenfield | ..... | D9/443 |
| 2011/0290754 | A1 * | 12/2011 | Taber et al. | ..... | 215/329 |

FOREIGN PATENT DOCUMENTS

| | | | | | |
|---|---|---|---|---|---|
| DE | 20 2006 010719 | U1 | 9/2006 | | |
| EP | 0679582 | A1 | 11/1995 | | |
| GB | 503173 | A | 4/1939 | | |
| GB | 766165 | A * | 1/1957 | ..... | B65D 41/04 |
| JP | 49128664 | U | 12/1974 | | |
| NL | 6908236 | | 2/1970 | | |
| NL | 6903320 | A | 9/1970 | | |
| WO | WO 2013/107736 | A1 | 7/2013 | | |

OTHER PUBLICATIONS

International Patent Application No. PCT/EP2013/050662: International Search Report dated Mar. 1, 2013, 2 pages.

Great Britain Patent Application No. 1200726.6: Search Report under Section 17(5) dated May 8, 2012, 6 pages.

* cited by examiner

SCREW LID FOR A FOOD CONTAINER

CROSS-REFERENCE TO RELATED APPLICATIONS

This application is the National Stage of International Application No. PCT/EP2013/050662, filed Jan. 15, 2013, which claims the benefit of GB application number 1200726.6, filed Jan. 17, 2012, the disclosures of which are incorporated herein by reference in their entirety.

TECHNICAL FIELD

The invention relates to a screw lid for a food container.

BACKGROUND

When closing and opening screw lids on food containers, a user generally holds the container in one hand and the screw lid in the opposite hand and applies a relative torque between the container and screw lid. Typically, a clockwise torque is applied to close a screw lid, and an anti-clockwise torque is applied to open a screw lid.

Users may find it difficult to open screw lids that have been fitted by themselves, other users or mechanical processes such as when a food container is filled by a food manufacturer. Indeed, food containers may be vacuum sealed, which may result in an increased torque required to open the container for the first time after it is bought. The problem of opening food container lids may be experienced by the elderly or infirm in particular. Users of this type may not have the grip strength required to apply the requisite torque.

SUMMARY OF THE INVENTION

According to the invention there is provided a screw lid for a food container and comprising: a series of radially extending asymmetric protrusions arranged around a peripheral edge region, wherein the asymmetric protrusions facilitate enhanced gripping when the lid is turned in an opening direction as compared to the gripping facilitated when the lid is turned in a closing direction. Each asymmetric protrusion may have a maximum radial extent that is curved to smooth an outer surface of the screw lid.

Optionally, the maximum radial extent defines a filleted exterior corner.

Optionally, the curved maximum radial extent is rounded.

Optionally, each asymmetric protrusion further comprises a minimum radial extent defining an interior corner filleted to smooth an outer surface of the screw lid.

Optionally, the interior corner fillet is rounded.

Optionally, the curved maximum radial extent is contiguous with the filleted minimum radial extent. Optionally, the end of the curved maximum radial extent is directly connected to the start of the filleted minimum radial extent.

The enhanced gripping in the opening direction permits a greater torque to be applied by users, in particular elderly or infirm users, wishing to open the lid.

Optionally, each asymmetric protrusion is generally triangular.

The generally triangular asymmetric protrusion presents a longer more gradually extending face to react against the user's hand in the closing direction, and a shorter more sharply extending face to react against the user's hand in the opening direction. This facilitates the enhanced gripping in the opening direction.

Optionally, each asymmetric protrusion comprises a first outer side that is longer than a second outer side.

Optionally, the maximum radial extent is defined by a vertex formed by the first and second outer sides, wherein the vertex is curved to smooth an outer surface of the screw lid.

Optionally, the minimum radial extent is defined by a vertex formed between the second outer side and a first outer side of an adjacent asymmetric protrusion, wherein the vertex is filleted to smooth an outer surface of the screw lid.

Optionally, the second outer side is substantially perpendicular to the circular peripheral edge region.

Optionally, the first outer side is curved inwardly relative to the circular peripheral edge region.

The inward curve of the first outer edge may be caused by a linear increase in radial extent of the asymmetric protrusion around the circumference of the lid and may provide for a smoother surface reacting against the user's hand when closing the lid.

Optionally, the first and second outer sides of the plurality of asymmetric protrusions form an asymmetric sawtooth shape extending around the circular peripheral edge region.

Optionally, a surface of the second outer side is texturised.

The texturised second surface may further facilitate increased gripping by the hand of the user.

According to the invention in a second aspect there is provided a screw lid for a food container, and comprising a series of radial protrusions formed around its outer periphery such that enhanced gripping by a user is facilitated when turning the lid in an opening direction as compared to turning the lid in the closing direction. Each asymmetric protrusion may have a maximum radial extent that is curved to smooth an outer surface of the screw lid.

According to the invention in a third aspect there is provided a screw lid for a food container and comprising a plurality of generally triangular asymmetric teeth arranged around a periphery of the lid in a continuous sequence.

SPECIFIC DESCRIPTION

Generally, disclosed herein is a screw lid that allows a user to apply a greater torque when opening a screw lid than when closing the screw lid. The screw lid is for closing an opening of a food container and may, for example, be a screw lid of a jar or other household container.

Figure 1:
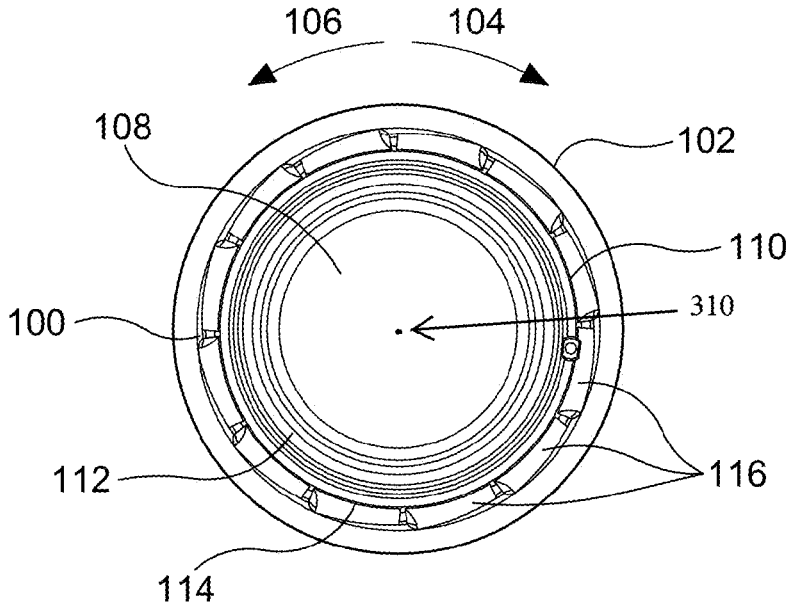
FIG. 1 shows a plan view of a screw lid fitted to a container.
Figure 2:
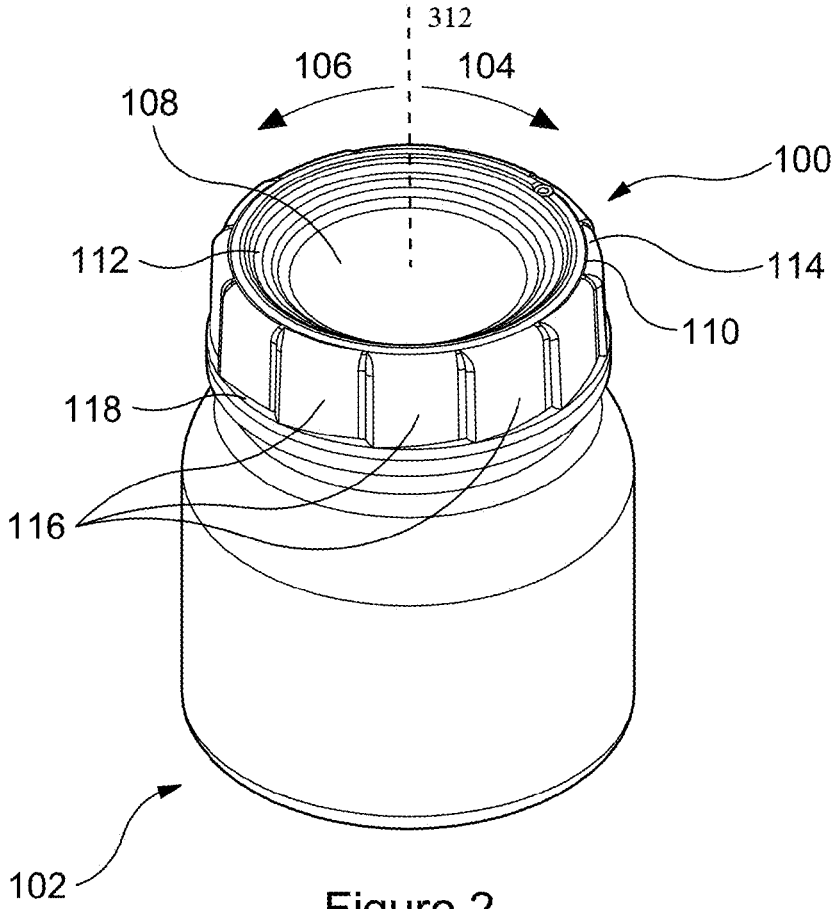
FIG. 2 shows a perspective view of a screw lid fitted to an opening of a container.

Referring to FIGS. 1 and 2 a screw lid 100 fitted to a food container 102 is shown. The screw lid 100 is closed (or tightened) in a clockwise direction 104 and opened (or loosened) in an anti clockwise direction 106.

The screw lid 100 comprises an upper surface 108 and a generally circular peripheral edge region 110. It will be understood by the skilled person that the generally circular peripheral edge region 110 may be other shapes. For the remainder of the document, the generally circular peripheral edge region 110 will be referred to as the peripheral edge region.

The peripheral edge region 110 has an upper lip 114 at the top that curls radially inwards. A series of radially extending asymmetric protrusions 116 are arranged around the peripheral edge region 110. The asymmetric protrusions 116 facilitate enhanced gripping when the screw lid 100 is turned in an opening direction (e.g. anti-clockwise) as compared to the gripping facilitated when the screw lid 100 is turned in a closing direction (e.g. a clockwise direction). The asymmetric protrusions 116 are described in greater detail below with reference to FIG. 3.

The upper surface 108 of the screw lid 100 is sunken with respect to the upper lip 114 of the peripheral edge region 110. The upper surface 108 is flat in a central area and has a radially ramped portion extending from the flat central area of the upper surface 108 to the underside of the upper lip 114.

A lower edge 118 of the screw lid 100 is circular, the outer extent of the circular lower edge 118 being the same as the maximum radial extent of the asymmetric protrusions 116.

The circular peripheral edge region 110 of the screw lid 100 may be independently rotatable with respect to the upper surface 108, such as in an Orbit Lid manufactured by Crown Holdings, Inc.

In exemplary screw lids 100, the peripheral edge region 110 may be manufactured from a plastics material. The plastics material may comprise a thermoplastic resin such as, for example, polypropylene or high density polyethylene. Additives may be used for colouration, lubricity and/or anti-static properties. The skilled person will understand that other materials may also be used to manufacture the peripheral edge region 110.

Figure 3:
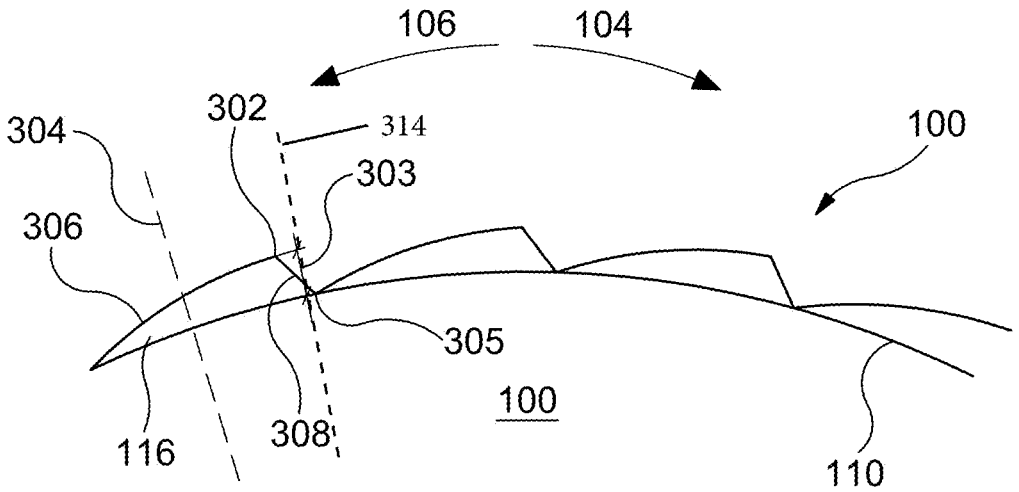
FIG. 3 is a schematic representation of a section of a peripheral edge region of a screw lid.

FIG. 3 shows a schematic representation of a section of a peripheral edge region 110. For clarity, the schematic representation of FIG. 3 does not show all the features of a screw lid 100, but focuses on the features of a screw lid 100 that facilitate the enhanced gripping in the opening direction as compared to the gripping in the closing direction.

The asymmetric protrusions 116 are generally triangular. In exemplary screw lids, the asymmetric protrusions 116 may form generally triangular asymmetric teeth arranged around the periphery of the lid in a continuous sequence. In other exemplary screw lids the asymmetric protrusions 116 may be other shapes, such as a lobed shape.

As used herein, the term "asymmetric" with reference to the protrusions 116 encompasses asymmetry about an axis formed by a radial line extending from the centre 310 of the lid 100 and circumferentially bisecting the protrusion 116. The centre 310 of the lid 100 defines a center axis 312 about which the lid rotates. The asymmetry may be embodied in that each protrusion is biased in a closing direction of the screw lid 100. That is, a majority of the volume of each protrusion 116 may be located to the side of the axis that is in the closing direction.

The asymmetric protrusions 116 form a series around the circumference 300 of the peripheral edge region 110 of the screw lid 100. That is, the asymmetric protrusions 116 are positioned end-to-end around the circumference of the lid 100. For the avoidance of doubt, it is noted that an asymmetric protrusion 116 comprises those parts of the screw lid that extend radially from the peripheral edge region 110. In alternative screw lids, the asymmetric protrusions 116 may be circumferentially spaced apart around the peripheral edge region 110 and not be positioned end-to-end to form a sequence.

Each asymmetric protrusion 116 has a maximum radial extent, or radial maximum, 302. Each radial maximum 302 is circumferentially offset from the centre 304 of each protrusion 116 in the closing direction 104. The centre 304 of each protrusion 116 is defined by a radial line extending from the centre of the screw lid 100 and circumferentially bisecting the protrusion 116. That is, the centre of each protrusion 116 is the mid-point of its circumferential length. By offsetting the radial maximum 302 from the centre 304 of each protrusion 116 in the closing direction, each protrusion 116 is made asymmetric.

Each protrusion 116 has a first, longer, outer side 306 extending from the peripheral edge region 110 to the radial maximum 302 in a closing direction 104, and a second, shorter, outer side 308 extending from the peripheral edge region 110 to the radial maximum 302 in the opening direction 106. The radial extent of the first outer side 306 increases around the circumference of the peripheral edge region in the closing direction 104, and the radial extent of the second outer side 308 increases around the circumference of the peripheral edge region in the opening direction 106. The rate of increase of radial extent of the first outer side 306 is less than the rate of increase of radial extent of the second outer side 308. The second outer side 308 is substantially perpendicular to the peripheral edge region 110. The second outer side 308 therefore presents a friction face in a closing direction of the screw lid 100 such that a user's hand is able to gain better friction against the second outer side 308 of the lid 100 in an opening direction, and is thereby able to impart a greater torque in the opening direction.

The maximum radial extent 302 of the asymmetric protrusions 116 from the peripheral edge region 110, i.e. the dimension 303 as measured along a radial line 314 that extends from the center axis 312 to an innermost point 316 of the linear portion of the second side 308*a* (shown in FIG. 3*a*), may be in the range from 0.8 mm to 1.6 mm. In an exemplary lid 100, the maximum radial extent 302 of the asymmetric protrusions 116 from the peripheral edge region 110 may be in the range from 1.0 mm to 1.4 mm. In a specific exemplary lid 100, the maximum radial extent 302 of the asymmetric protrusions 116 from the peripheral edge region 110 is 1.2 mm . The total maximum radial extent 302 of the asymmetric protrusions 116 from the centre of the lid 100 may be 43.5 mm.

For clarity, the lid 100 is shown in FIG. 3 having sharp vertices at the maximum radial extent 302 and at a minimum radial extent 305. The maximum radial extent defines an exterior corner. The minimum radial extent defines an interior corner. In exemplary lids 100, the maximum 302 and/or minimum 305 radial extents may be curved or filleted to present a smoother surface. That is, the exterior corner of the maximum radial extent may be curved or filleted and/or the interior corner of the minimum radial extent may be curved or filleted. In particular, the maximum radial extent 302 may be filleted so that an outer edge of the lid 100 feels smooth to a user and does not tend to cut into the skin of a user when opening the lid 100. The fillet of the minimum radial extent 305 may be rounded and have a radius in the range from 0.15 mm to 0.25 mm. In an exemplary lid 100, the fillet of the minimum radial extent 305 may have a radius of 0.2 mm. The fillet of the maximum radial extent 302 may be rounded and have a radius in the range from 0.8 mm to 1.2 mm. In an exemplary lid 100, the fillet of the maximum radial extent 302 may have a radius of 1.0 mm.

For the avoidance of doubt, it is noted that, as used herein, the term "fillet" encompasses a curving or rounding of either an exterior or an interior corner.

Figure 3A:
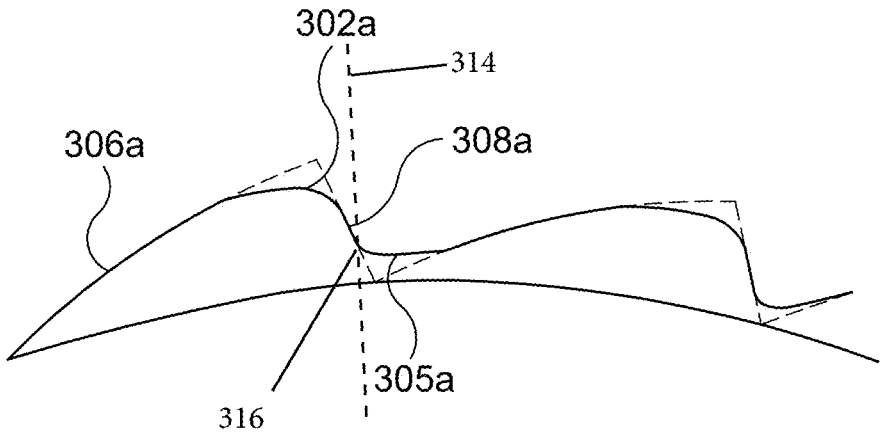
FIG. 3*a* is a schematic representation of a section of a peripheral edge region of a screw lid.
Figure 6:
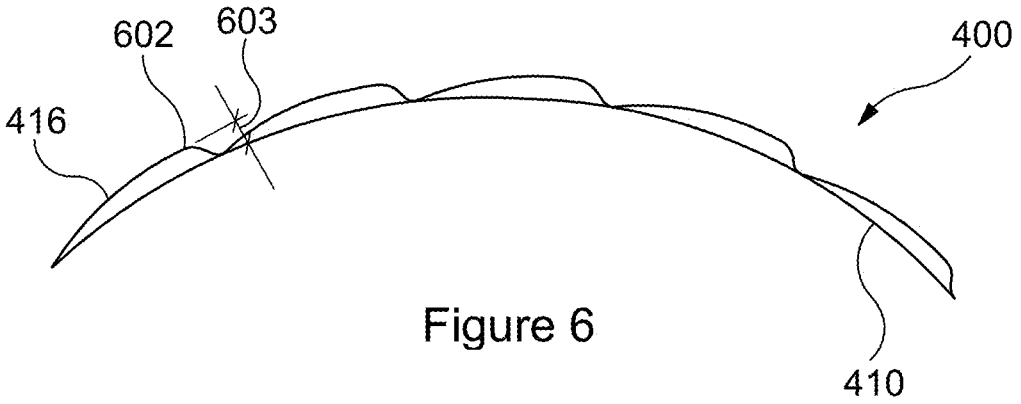
FIG. 6 is a schematic representation of a peripheral edge region of a screw lid.

FIG. 3*a* shows a schematic representation of a section of a peripheral region of a screw lid, in which the maximum radial extent 302*a* is filleted and the minimum radial extent 305*a* has been filleted. If the first outer side 306*a* and the second outer side 308*a* were to be extended, they would meet at vertices, which, for illustrative purposes, are shown as dashed lines in FIG. 3*a*. It can be seen, therefore, that the exterior corner of the maximum radial extent 302*a* has been curved. The interior corner of the minimum radial extent 305*a* has been filleted. This arrangement is also shown in FIG. 6.

In a particular screw lid, the filleted maximum radial extent 302*a* is contiguous with the filleted minimum radial extent 305*a*. That is, the end of filleted maximum radial extent 302*a* runs directly into the start of the filleted minimum radial extent 305*a* and there is no un-curved or un-filleted region between them.

The filleted exterior corner of the maximum radial extent 302*a* and/or the filleted interior corner of the minimum radial extent 305*a* provide a smoother surface to a user when gripping the screw lid. In particular, the curved exterior corner of the maximum radial extent 302*a* is less painful to a user when gripping the screw lid tightly. This facilitates tighter gripping of the screw lid by a user and thereby allows a greater torque to be applied to the screw lid. This is particularly advantageous when opening a screw lid fitted to a food container, as these screw lids are typically sealed very tightly and require a high opening torque. Screw lids disclosed herein allow a user to grip the screw lid more tightly without experiencing pain, thereby allow a greater opening torque to be applied.

Screw lids disclosed herein have clearly different designs to other screw lids in that the corners of the ribs of the screw lids disclosed herein are heavily filleted. The reason for this is so that the closure can be gripped tightly to enable turning without slipping in the hand during opening.

Other designs have tight corners which will be painful if gripped sufficiently tightly to allow opening. This is presumably because they are designed for closures that are not sealed very tightly and thus do not require a high opening torque to enable removal.

The screw lids disclosed herein comprising a plastic band (FIG. 1) and metal closure (FIG. 4) show that the rib fillets (the fillets at the maximum radial extents) are so large that they merge into the groove fillets (the fillets at the minimum radial extent) so that there is no un-filleted region between the rib and groove.

The increase in radial extent of the first outer side 306 may be linear around the circumference of the peripheral edge region 110. This may provide an inwardly curved first outer side 306. That is, the first outer side 306 may be curved radially inwards, as opposed to being tangential to the peripheral edge region 110.

In this way, the first 306 and second 308 outer sides of each asymmetric protrusion 116 form an asymmetric sawtooth shape extending around the circumference 300 of the peripheral edge region 110. The screw lid 100 therefore has the form of a ratchet wheel.

Generally, the asymmetric protrusions 116 present a smoother gripping surface in the closing direction 104 than the gripping surface presented in the opening direction 106. This is because the longer first outer side 306 has a slow rate of increase of radial extent when compared to the shorter second outer side 308.

The relatively smooth surface presented by the longer first outer sides 306 does not provide as great an amount of friction against, for example, a user's hand when compared to the amount of friction provided by the shorter second outer sides 308. Therefore, when a user closes the screw cap 100 over an opening of the container 102, the amount of torque the user is able to apply against the longer first outer sides 306 is less than the amount of torque the user is able to apply against the shorter second outer sides 308. Put another way, the user will be able to apply a greater torque to the screw lid 100 when opening than when closing. This provides the advantage that users having a lessened gripping strength, such as the elderly or infirm, are able to apply a greater torque when opening the lid 100.

The series of radial protrusions 116 formed around the outer periphery of the lid 100 therefore facilitate enhanced gripping by a user when turning the lid 100 in an opening direction as compared to turning the lid 100 in the closing direction.

In other screw lids 100, the surface of the shorter second outer sides 308 may be texturised. This provides even greater friction between the second outer sides 308 and a user's hand and allows the user to apply even greater torque when opening the screw lid 100.

The screw lid 100 is suitable for use on a 40 mm diameter opening, wherein the diameter of the opening is measured from the outer edge of the screw thread of the container. Other exemplary screw lids 100 may be suitable for use on 63 mm or 82 mm openings. Further, the screw lid 100 is configured to operate with a multi-start helical thread, as is known in the art. The container and the helical thread may be manufactured from glass.

Typically, the torque required to open a screw lid used on a 63 mm opening of a container is 3.4 Newton-meters. The invention as herein described allows enhanced gripping of the screw lid and, in turn, allows the required torque to be more easily applied by a user, such as an elderly or infirm person.

The depth of the lid 100 may be regular, for example, approximately 10 mm for a 63 mm diameter opening, or deep, for example, approximately 15 mm for a 63 mm diameter opening.

Figure 4:
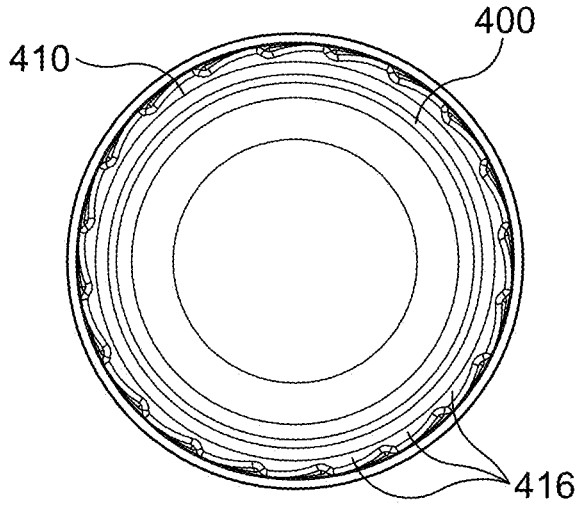
FIG. 4 is a plan view of a screw lid fitted to an opening of a container.
Figure 5:
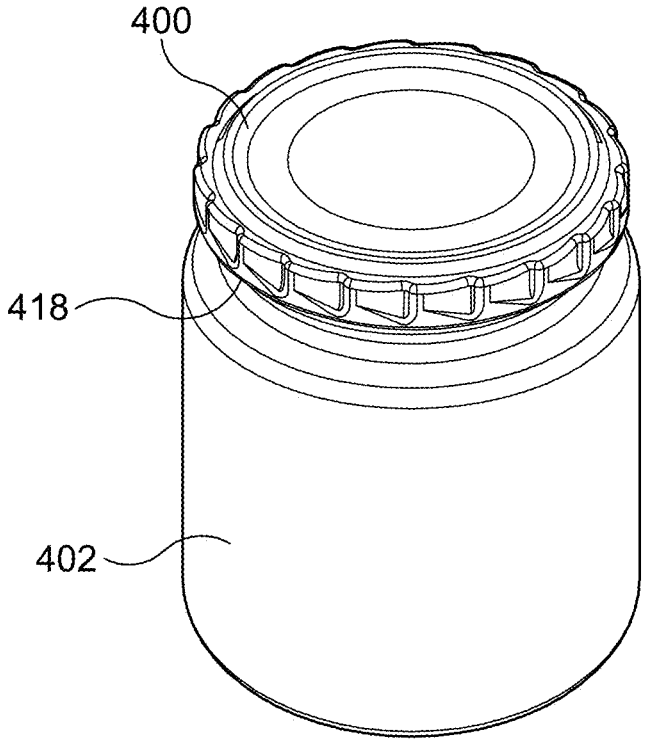
FIG. 5 is a perspective view of a screw lid fitted to a container.

FIG. 4 shows a plan view of a screw lid 400. FIG. 5 shows a perspective view of a screw lid 400 fitted to a container 402. FIG. 6 shows a schematic representation of a section through a screw lid 400. The lid 400 may comprise one or more of the features disclosed above in relation to the lid 100. These features are not disclosed again in relation to the lid 400.

The screw lid 400 of FIGS. 4 to 6 is a single piece unit manufactured from metal, such as steel. In a specific example, the lid 400 is manufactured from 0.16 mm double reduced steel.

The description of the screw lid 400 is limited to those features that differ from the screw lid 100. Any features of the screw lid 400 not described below are the same as those corresponding features of the screw lid 100.

Arranged on a peripheral edge region 410 is a series of asymmetric protrusions 416. The asymmetric protrusions 416 facilitate enhanced gripping of the lid 400 in an opening direction when compared to the gripping facilitated in a closing direction.

The asymmetric protrusions 416 of the screw lid 400 present a smoother profile when compared to the asymmetric protrusions 116 of the screw lid 100. The maximum radial extent 602 of the asymmetric protrusions is in the range from 0.7 mm to 1.1 mm from the peripheral edge region 410. That is, the dimension 603 is in the range from 0.7 mm to 1.1 mm. In other exemplary screw lids 400, the maximum radial extent 602 of the asymmetric protrusions 416 may be in the range from 0.8 mm to 1.0 mm. In a specific exemplary screw lid, the maximum radial extent 602 of the asymmetric protrusions is 0.9 mm. The smoother profile of the screw lid 400 allows the drawing of the metal blank, used for manufacture of the screw lid 400, without damaging an internal or an external coating on the screw lid 400.

Figure 7A:
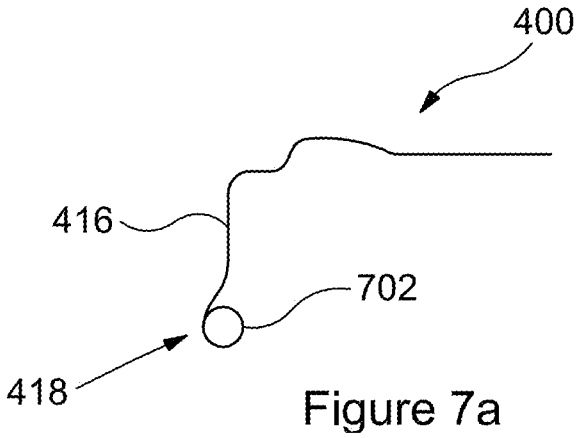
FIG. 7A is a section through a peripheral edge region of a screw lid.
Figure 7B:
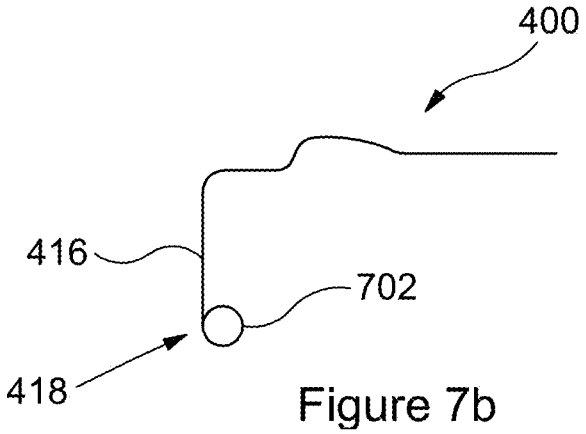
FIG. 7B is a section through a peripheral edge region of a screw lid.

A lower edge 418 of the screw lid 400 is circular. FIGS. 7A and 7B show sections through an outer edge of exemplary screw lids 400. The lower edge 418 of the screw lid 400 comprises a curled lip 702. The curled lip 702 is inwardly facing and forms lugs that are configured to interact with a screw thread, typically a multi-start helical screw thread, to tighten and loosen the screw lid 400. In a specific exemplary screw lid, there is formed four such lugs, which are equidistantly spaced around the inner circumference of the screw lid 400.

The skilled person will envisage other screw lids without departing from the scope of the appended claims.

The invention claimed is:

1. A screw lid for a food container and comprising:

a center panel extending about a center axis;

a series of asymmetric protrusions arranged around a peripheral edge region of the lid and extending radially away from the center panel, each asymmetric protrusion having a first side and a second side, the first side being longer than the second side, and the second side having a linear portion that extends away from the center axis, the linear portion being angled in an opening direction away from a radial line that extends from the center axis to an innermost point of the linear portion of the second side, the asymmetric protrusions being configured to facilitate enhanced gripping when the lid is turned in the opening direction as compared to the gripping facilitated when the lid is turned in a closing direction, each asymmetric protrusion further having a maximum radial extent and a minimum radial extent that are filleted thereby producing an outer surface of the screw lid that is smooth; and the peripheral edge region having an upper lip that curls radially inward towards the center panel.

2. A screw lid according to claim 1, wherein the maximum radial extent is rounded.

3. A screw lid according to claim 1, wherein an interior corner fillet is rounded.

4. A screw lid according to claim 1, wherein the maximum radial extent is contiguous with the filleted minimum radial extent.

5. A screw lid according to claim 1, wherein each asymmetric protrusion is generally triangular.

6. A screw lid according to claim 1, wherein the first outer side is curved inwardly with respect to the circular peripheral edge region.

7. A screw lid according to claim 1, wherein the radial extent of the first outer side increases linearly with circumference in a closing direction.

8. A screw lid according to claim 1, wherein the first and second outer sides of the plurality of asymmetric protrusions form an asymmetric sawtooth shape extending around the circular peripheral edge region.

9. A screw lid according to claim 1, wherein a surface of the second outer side is texturized.

10. A screw lid according to claim 1, wherein the center panel defines a centerpoint that is sunken in relation to a top of the lid.

11. A screw lid according to claim 10, wherein the centerpoint is disposed below the upper lip of the peripheral edge region.

12. A screw lid according to claim 1, wherein the screw lid is a metal screw lid.

13. A screw lid according to claim 1, wherein the peripheral edge region of the lid comprises a plastics material.

14. A screw lid for a food container and comprising:

a center panel extending about a center axis;

a plurality of generally triangular asymmetric teeth arranged around a periphery of the lid in a continuous sequence, each asymmetric tooth having a first side and a second side, the first side being longer than the second side, and the second side having a linear portion that extends away from the center axis, the linear portion being angled in an opening direction away from a radial line that extends from the center axis to an innermost point of the linear portion of the second side, each asymmetric tooth further having a maximum radial extent and a minimum radial extent relative to the center panel that are filleted thereby producing an outer surface of the screw lid that is smooth; and a rounded upper lip of the periphery of the lid, the upper lip being curled radially inward toward the center panel.

15. A screw lid according to claim 14, wherein the center panel defines a centerpoint that is sunken in relation to a top of the lid.

16. A screw lid according to claim 15, wherein the centerpoint is disposed below the upper lip of the peripheral edge region.

17. A screw lid according to claim 14, wherein the screw lid is a metal screw lid.

18. A screw lid according to claim 14, wherein the periphery of the lid comprises a plastics material.

* * * * *